US011378270B2

(12) United States Patent
Xiao et al.

(10) Patent No.: US 11,378,270 B2
(45) Date of Patent: Jul. 5, 2022

(54) CABINET LAMP AND LAMP CABINET

(71) Applicants: SUZHOU OPPLE LIGHTING CO., LTD., Suzhou (CN); OPPLE LIGHTING CO., LTD., Shanghai (CN)

(72) Inventors: Liuhua Xiao, Suzhou (CN); Chenxi Bu, Suzhou (CN); Yisheng Xiao, Suzhou (CN); Xianglan Li, Suzhou (CN)

(73) Assignees: Suzhou Opple Lighting Co., Ltd., Suzhou (CN); Opple Lighting Co., Ltd., Shanghai (CN)

( * ) Notice: Subject to any disclaimer, the term of this patent is extended or adjusted under 35 U.S.C. 154(b) by 0 days.

(21) Appl. No.: 17/474,873

(22) Filed: Sep. 14, 2021

(65) Prior Publication Data

US 2021/0404644 A1 Dec. 30, 2021

Related U.S. Application Data

(63) Continuation of application No. PCT/CN2020/079519, filed on Mar. 16, 2020.

(51) Int. Cl.
*F21V 33/00* (2006.01)
*F21S 4/28* (2016.01)
(Continued)

(52) U.S. Cl.
CPC ..... *F21V 33/006* (2013.01); *F21S 4/28* (2016.01); *F21V 15/01* (2013.01); *F21V 17/16* (2013.01)

(58) Field of Classification Search
CPC ..... F21V 33/006; F21V 15/01; F21V 17/16; F21S 4/28
See application file for complete search history.

(56) References Cited

U.S. PATENT DOCUMENTS

2007/0047229 A1* 3/2007 Lee ..... F21V 15/013 362/237
2009/0141506 A1 6/2009 Lan et al.
(Continued)

FOREIGN PATENT DOCUMENTS

CN 203927583 U 11/2014
CN 203927585 U 11/2014
(Continued)

OTHER PUBLICATIONS

International Search Report of PCT Application No. PCT/CN2020/079519 dated Jun. 5, 2020 with English translation, (6p).

*Primary Examiner* — Tsion Tumebo
(74) *Attorney, Agent, or Firm* — Arch & Lake LLP

(57) ABSTRACT

The application relates to a cabinet lamp and a lamp cabinet. The cabinet lamp includes a lamp housing, an elastic member and a light-emitting assembly. The lamp housing includes a first shell plate and a second shell plate. The first shell plate and the second shell plate enclose a first space. A surface of the first shell plate surrounding the first space or a surface of the second shell plate surrounding the first space is provided with a first connection part. The elastic member includes a second connection part, the elastic member fits with the first space in a plugging-in manner, and the second connection part is in snap fit with the first connection part. The elastic member is configured to be installed on an inner top wall of the lamp cabinet. The light-emitting assembly is installed on the lamp housing.

15 Claims, 5 Drawing Sheets

(51) Int. Cl.
*F21V 15/01* (2006.01)
*F21V 17/16* (2006.01)

(56) References Cited

U.S. PATENT DOCUMENTS

| | | | | |
|---|---|---|---|---|
| 2010/0214769 | A1* | 8/2010 | Bhargava | F21V 3/04 362/125 |
| 2011/0051401 | A1* | 3/2011 | Bauer | F21S 4/28 362/125 |
| 2011/0286207 | A1* | 11/2011 | Chan | F21S 4/20 362/217.1 |
| 2015/0159848 | A1* | 6/2015 | Sieberth | F21V 21/005 362/311.02 |
| 2016/0053973 | A1* | 2/2016 | Tress | F21S 4/28 362/217.02 |
| 2018/0142846 | A1* | 5/2018 | Liu | F21S 4/28 |

FOREIGN PATENT DOCUMENTS

| | | | |
|---|---|---|---|
| CN | 203927586 | U | 11/2014 |
| CN | 203927649 | U | 11/2014 |
| CN | 209370988 | U | 9/2019 |
| CN | 209587888 | U | 11/2019 |
| KR | 20130140419 | A | 12/2013 |

* cited by examiner

CABINET LAMP AND LAMP CABINET

CROSS-REFERENCE TO RELATED APPLICATIONS

This application is based upon and claims the priority of PCT patent application No. PCT/CN2020/079519 filed on Mar. 16, 2020 which claims priority to the Chinese patent application No. 201920335553.0 filed on Mar. 15, 2019, the entire contents of which are hereby incorporated by reference herein for all purposes.

TECHNICAL FIELD

This application relates to a technical field of lighting, in particular to a cabinet lamp and a lamp cabinet.

BACKGROUND

With the development of home lighting, more and more lamp cabinets need LED lighting fixtures. The existing connection mode between a cabinet lamp and a lamp cabinet is complicated, and the disassembly or the replacement of cabinet lamps is also complicated.

The cabinet lamp in the existing lamp cabinet has glare, and the user experience is poor. In order to solve the glare problem, it is necessary to install optical elements in the cabinet lamp to eliminate glare phenomenon. Due to the need of installing additional optical elements in the cabinet lamp, the volume of the cabinet lamp is increased, which will lead to a corresponding reduction in storage space in the lamp cabinet.

SUMMARY

The technical solution of this application is to provide a cabinet lamp with convenient installation and small occupied space, and a lamp cabinet containing the cabinet lamp.

The technical solution of this application is as follows:

A cabinet lamp includes: a lamp housing including a first shell plate and a second shell plate, the first shell plate and the second shell plate are connected to each other, the first shell plate and the second shell plate enclose a first space, a surface of the first shell plate surrounding the first space or a surface of the second shell plate surrounding the first space is provided with a first connection part; an elastic member comprising a second connection part, the elastic member fits with the first space in a plugging-in manner, the second connection part is in snap fit with the first connection part, and the elastic member is configured to be installed on an inner top wall of a lamp cabinet; and a light-emitting assembly installed on the lamp housing.

A lamp cabinet, comprising: a cabinet body, and the cabinet lamp, the cabinet body is provided with an accommodation space, and the cabinet lamp is installed on an inner top wall of the cabinet body.

The cabinet lamp of this application has the following advantages: after the elastic member is installed on the inner top wall of the lamp cabinet, the first space of the lamp housing is aligned with the second connection part, and then the lamp housing is pushed towards the inner top wall of the lamp cabinet, so that the second connection part enters the first space first, and then the first connection part is in snap fit with the second connection part, thereby realizing the connection between the lamp housing and the elastic member. Compared with the existing cabinet lamp, the lamp housing of the cabinet lamp of this application and the cabinet lamp of this application are more convenient to be installed on the inner top wall of the lamp cabinet. Due to the existence of the first space, and the elastic member fits with the first space in a plugging-in manner, that is, a part of the elastic member is located in the first space, the occupied space of the cabinet lamp is reduced.

The lamp cabinet of this application has following advantages: after the elastic member is installed on the inner top wall of the lamp cabinet, the first space of the lamp housing is aligned with the second connection part, and then the lamp housing is pushed towards the inner top wall of the lamp cabinet, so that the second connection part enters the first space first, and then the first connection part is in snap fit with the second connection part, thereby realizing the connection between the lamp housing and the elastic member. Compared with the existing cabinet lamp, the lamp housing of the cabinet lamp of this application and the cabinet lamp of this application are more convenient to be installed on the inner top wall of the lamp cabinet. Due to the existence of the first space, and the elastic member fits with the first space in a plugging-in manner, that is, a part of the elastic member is located in the first space, and the occupied space of the cabinet lamp is reduced. Because the cabinet lamp in the lamp cabinet occupies a less space, the lamp cabinet of this application has more storage space. In addition, because the light illuminating the objects in the lamp cabinet is the reflected light, there is no glare, and there is no need to install a diffusion plate in the lamp housing to homogenize the light, thereby reducing the volume of the lamp housing, and allowing the lamp housing to be thinner and to occupy a less space.

Figure 1:
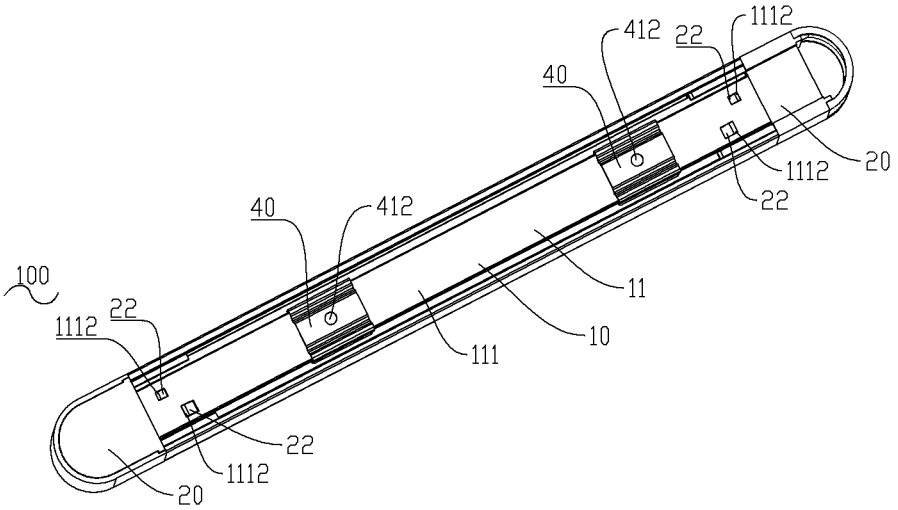
FIG. 1 is an overall view of a cabinet lamp provided by one or more examples of this application.

The names and labels of components in the drawing are as follows:

Cabinet lamp 100, main shell 10, first shell plate 11, main plate 111, first slot 1111, clamping groove 1112, side plate 112, first groove 1121, second shell plate 12, first limiting protrusion 121, second slot 122, second limiting protrusion 123, third slot 124, first space 13, limiting groove 14, end cover 20, guide part 21, fastening-holding part 22, light-transmitting cover 30, cover main body 31, cover side 32, fourth slot 321, third limiting protrusion 322, elastic member 40, connecting part 41, second protrusion 411, mounting hole 412, main body 42, first protrusion 421, clamping space 43, light-emitting assembly 50, a lamp plate 50, light board 51, installation cavity 60, lamp cabinet 200, top plate 210, inner top wall 211, bottom plate 220, inner bottom wall 221, side plate 230, inner side wall 231, accommodation space 240.

DETAILED DESCRIPTION

Examples of the present disclosure will be described in more detail below with reference to the accompanying drawings. Although examples of the present disclosure are shown in the accompanying drawings, it should be understood that the present disclosure may be implemented in various forms and should not be limited by the examples set forth herein. On the contrary, these examples are provided to enable a more thorough understanding of the present disclosure and to fully convey the scope of the present disclosure to those skilled in the art.

It should be noted that the features in the examples of the disclosure can be combined with each other without conflict. Sometimes, when it is necessary to adjust the irradiation angle of the lamp, it is generally to adjust the irradiation angle of the lamp manually or by using tools, which can't intelligently adjust the irradiation angle according to personal wishes and cannot meet the needs of users.

As shown in FIG. 1, this embodiment discloses a cabinet lamp 100. The cabinet lamp 100 includes a lamp housing, an elastic member 40, and a light-emitting assembly 50. The lamp housing includes a main shell 10, and the main shell 10 includes a first shell plate 11 and second shell plate 12. The first shell plate 11 and the second shell plate 12 are connected to each other, and the first shell plate 11 and the second shell plate 12 enclose a first space 13. A surface of the first shell plate 11 surrounding the first space 13 or a surface of the second shell plate 12 surrounding the first space 13 is provided with a first connection part. The elastic member 40 is made of an elastic material and has suitable elasticity and rigidity. The elastic member 40 includes a second connection part, the elastic member 40 fits with the first space 13 in a plugging-in manner, and the second connection part is in snap fit with the first connection part. The elastic member 40 is configured to be installed on an inner top wall 211 of a lamp cabinet 200. The light-emitting assembly 50 is installed on the lamp housing.

The lamp cabinet 100 of this embodiment has following advantages: after the elastic member 40 is installed on the inner top wall of the lamp cabinet 200, the first space 13 of the lamp housing is aligned with the second connection part, and then the lamp housing is pushed towards the inner top wall 211 of the lamp cabinet 200, so that the second connection part enters the first space 13 first, and then the first connection part is in snap fit with the second connection part, thereby realizing the connection between the lamp housing and the elastic member 40. Compared with the existing cabinet lamp, the lamp housing of the cabinet lamp 100 of this embodiment and the cabinet lamp 100 of this embodiment are more convenient to be installed on the inner top wall 211 of the lamp cabinet 200. Due to the existence of the first space 13, and the elastic member 40 fits with the first space 13 in a plugging-in manner, that is, a part of the elastic member 40 is located in the first space 13, the occupied space of the cabinet lamp is reduced.

When disassembling the lamp housing, the lamp housing is pulled away from the inner top wall 211 of the lamp cabinet 200, so that the lamp housing can be separated from the elastic member 40. It is more convenient to detach the lamp housing of the cabinet lamp 100 of this embodiment from the inner top wall 211 of the lamp cabinet 200.

Figure 4:
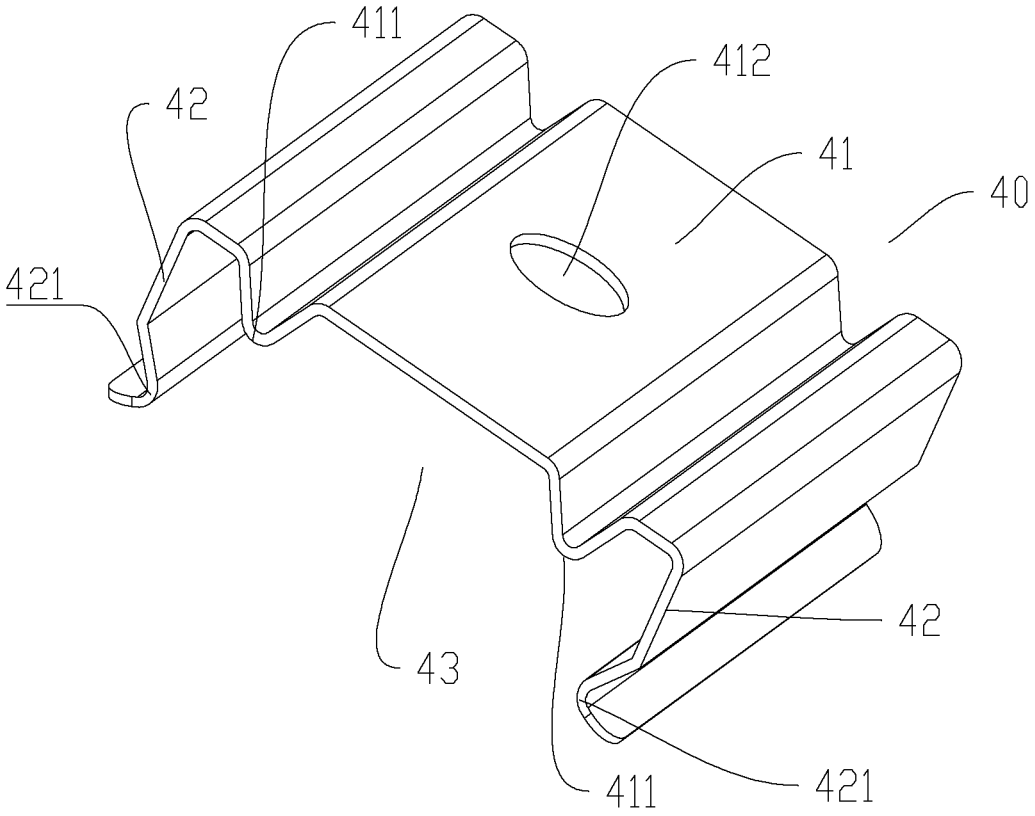
FIG. 4 is a structural schematic diagram of the elastic member provided by the one or more examples of this application.

Additionally or alternatively, as shown in FIG. 4, the elastic member 40 of this embodiment is formed by bending an integrally metal sheet, and the elastic member 40 has few parts, which does not need to be assembled, it is relatively convenient to install and disassemble, and it has low cost.

The first connection part may be a groove, and correspondingly, the second connection part is a protrusion. The first connection part may be a protrusion, and correspondingly, the second connection part is a groove. The first connection part may be arranged on a surface of the first shell plate 11 enclosing the first space 13, or the first connection part may also be arranged on a surface of the second shell plate 12 enclosing the first space 13. If the first connection part is arranged on the surface of the second shell plate 12 surrounding the first space 13, it is not convenient for an end cover 20 described below to be plugged in and fits with the main shell 10. If the first connection part is arranged on the surface of the first shell plate 11 surrounding the first space 13, and the first connection part is a protrusion and the second connection part is a groove, the first space 13 will be occupied, so that it is not convenient for the end cover 20 described below to be plugged in and fits with the main shell 10, or the entire occupied space of the cabinet lamp 100 needs to be increased. Therefore, in order to facilitate the plug fitting with each other between the end cover 20 and the main shell 10, and in order to reduce the volume of the cabinet lamp 100, Additionally or alternatively, a first groove 1121 is formed on the surface of the first shell plate 11 surrounding the first space 13 in this embodiment, and the first groove 1121 is the first connection part. The elastic member 40 includes a first protrusion 421, and the first protrusion 421 is the second connection part.

Additionally or alternatively, a surface of the first groove 1121 is an arc surface, and a surface of the first protrusion 421 facing the first groove 1121 is an arc surface. The advantage is that, when the cabinet lamp 100 is installed, the lamp housing is pushed toward the inner top wall 211 of the lamp cabinet 200, so that the first protrusion 421 enters the first space 13 first, and then the first protrusion 421 can smoothly enter the first groove 1121 along the arc surface of the first groove 1121, thereby realizing the snap-fit between the first groove 1121 and the first protrusion 421, that is, the snap-fit between the second connection part and the first connection part is realized. When disassembling the lamp housing of the cabinet lamp 100, the lamp housing is pulled away from the inner top wall 211 of the lamp cabinet 200, and the first protrusion 421 can be smoothly separated from the first groove 1121 along the arc surface of the first groove 1121, thereby completing the disassembly of the lamp housing from the inner top wall 211 of the lamp cabinet 200. That is, in this embodiment, the surface of the first groove 1121 is an arc surface, and the surface of the first protrusion 421 facing the first groove 1121 is an arc surface, so that it is relatively convenient for the connection and disassembly of the lamp housing and the elastic member 40.

Figure 2:
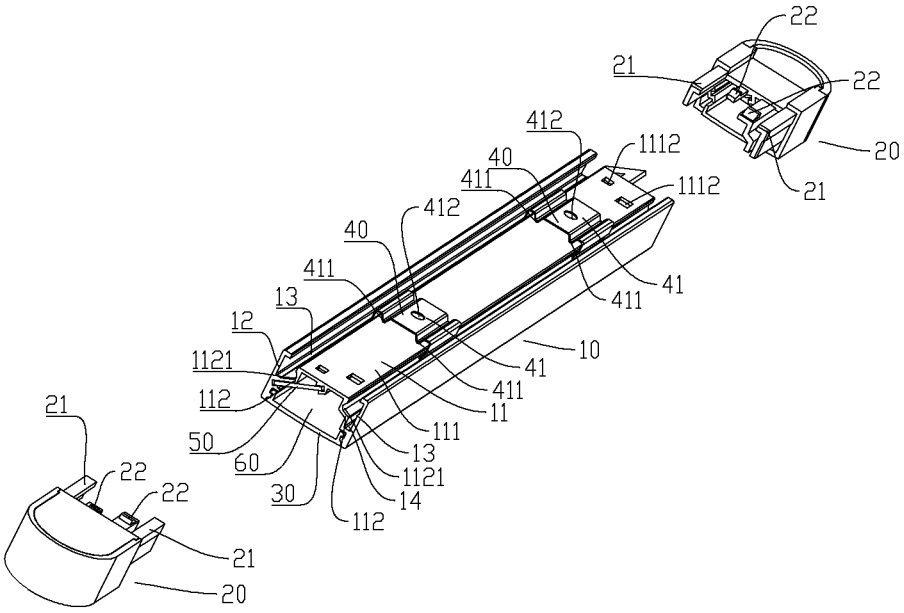
FIG. 2 is an exploded view of the cabinet lamp provided by the one or more examples of this application.
Figure 3:
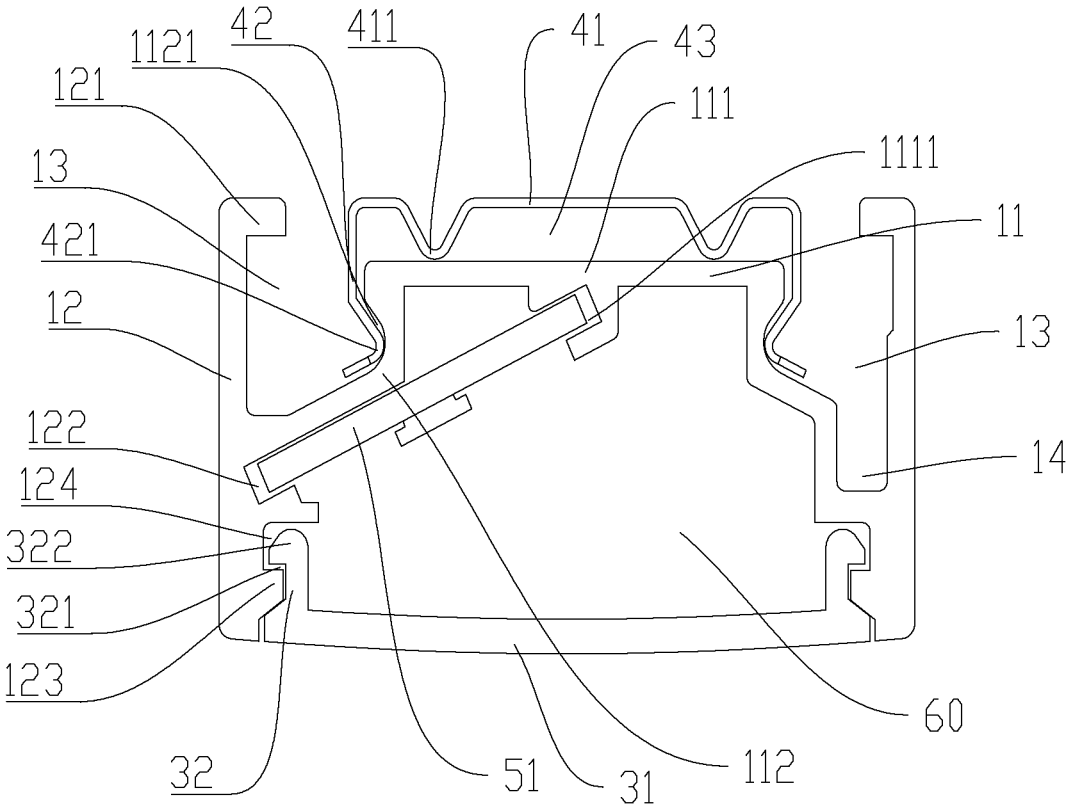
FIG. 3 is an end view of the connection between a main shell and an elastic member provided by the one or more examples of this application.

As shown in FIG. 2 and FIG. 3, the cabinet lamp 100 of this embodiment may be a strip lamp. Additionally or alternatively, two second shell plates 12 are provided, the first shell plate 11 is arranged between the two second shell plates 12, and the two long sides of the first shell plate 11 are connected to the second shell plates 12 respectively, that is, the two ends of the first shell plate 11 in a width direction are connected to the second shell plates 12, respectively. Specifically, the two ends of the first shell plate 11 in the width direction are connected to an inner surface of a middle position of second shell plate 12, respectively. At least two elastic members 40 are provided, as shown in FIG. 2, two elastic members 40 are provided, and the two elastic members 40 are arranged at a spacing.

Both of a surface of the second shell plate 12 facing the first shell plate 11 and a surface of the second shell plate 12 for enclosing an installation cavity 60 are inner surfaces. An outer surface of the first shell plate 11 and an inner surface of one of the second shell plates 12 enclose a first space 13, and the outer surface of the first shell plate 11 and the inner surface of the other second shell plate 12 enclose another first space 13. Each of the two first spaces 13 is arranged along a length direction of the lamp housing, and the two first spaces 13 are symmetrically arranged in the width direction of the lamp housing. The elastic member 40 includes a connection part 41 and two main bodies 42 connected at two ends of the connection part 41. Each of the two main bodies 42 is provided with the first protrusion 421. The two main bodies 42 of the elastic member 40 fits with the two first spaces 13 in a plugging-in manner, respectively, and the two first protrusions 421 are in snap fit with the two first grooves 1121, respectively, which improves the connection reliability between the lamp housing and the elastic member 40 and allows the lamp housing to subject a uniform stress. The connection part 41 and the two main bodies 42 enclose a clamping space 43, and the first shell plate 11 is plugged into the clamping space 43.

The first shell plate 11 includes a main plate 111 and two side plates 112, two ends of the main plate 111 in a width direction are connected to the two side plates 112, respectively. A surface of the main plate 111 facing the inner top wall 211 of the lamp cabinet 200 is an outer surface, and the side plate 112 extends away from an outer surface of the main plate 111. The side plate 112 and the second shell plate 12 are connected to each other, and an outer surface of the side plate 112 and the inner surface of the second shell plate 12 enclose a first space 13. The main plate 111 and a part of the side plate 112 are located in the clamping space 43.

As shown in FIG. 4, Additionally or alternatively, the connection part 41 is partially bent to form a second protrusion 411, and a length direction of the second protrusion 411 is parallel to a length direction of the first shell plate 11. As shown in FIG. 3, the second protrusion 411 faces the first shell plate 11. The advantage of forming the second protrusion 411 by bending the connection part 41 partially is that the second protrusion 411 encloses a groove, which provides a space for the deformation of the elastic member 40 and reduces the difficulty of the deformation of the elastic member 40, thereby increasing the ease of the snap-fit between the first protrusion 421 and the first groove 1121, and also increasing the ease of separation between the first protrusion 421 and the first groove 1121. In this way, it is convenient to connect and disassemble the lamp housing and the elastic member 40 in this embodiment. In order to further reduce the difficulty of the deformation of the elastic member 40, two second protrusions 411 are provided in this embodiment, and the two second protrusions 411 are symmetrically arranged.

As shown in FIG. 4, Additionally or alternatively, the connection part 41 is provided with a mounting hole 412, the mounting hole 412 is arranged between the two second protrusions 411, and the mounting hole 412 is configured to connect to the inner top wall 211 of the lamp cabinet 200. The elastic member 40 can be installed on the inner top wall 211 of the lamp cabinet 200 by putting a screw to pass through the mounting hole 412. The advantage of forming the mounting hole 412 in the connection part 41 is that the volume of the elastic member 40 is not increased, which is beneficial for the cabinet lamp 100 of this embodiment to occupy a less space.

Additionally or alternatively, one end of the second shell plate 12 surrounding the first space 13 is an inner end, a surface of the connection part 41 facing away from the first shell plate 11 is an outer surface, and the outer surface of the connection part 41 is coplanar with an end surface of the inner end of the second shell plate 12. Therefore, after the elastic member 40 is connected to the lamp housing, the elastic member 40 is hidden between the two second shell plates 12, and the elastic member 40 cannot be seen from the outside, which allows the cabinet lamp 100 of this embodiment to be more beautiful and to reduce the space occupied by the cabinet lamp 100 of this embodiment in the lamp cabinet 200.

Additionally or alternatively, the lamp housing has an installation cavity 60, and the light-emitting assembly 50 is arranged in the installation cavity 60. The light-emitting assembly 50 includes a light board 51 and a light body installed on the light board 51. Two ends of the light board 51 are installed on two adjacent inner walls of the lamp housing, respectively, that is, the light board 51 in this embodiment is obliquely arranged in the installation cavity 60. An intersection angle is formed between the light board 51 and the second shell plate 12, and the intersection angle between the light board 51 and the second shell plate 12 ranges from 20 degrees to 70 degrees. After the cabinet lamp 100 is installed on the inner top wall 211 of the lamp cabinet 200, an intersection angle between the light board 51 and an inner bottom wall 221 is formed and is in a range from 20 degrees to 70 degrees; in this angle range, more light from the light body can be irradiated to an inner side wall 231 of the lamp cabinet 200. The light irradiating on the inner side wall 231 of the lamp cabinet 200 is reflected by the inner side wall 231 and then irradiates on the inner bottom wall 221 of the light cabinet 200 to illuminate an object in the lamp cabinet 200. Because the light for illuminating the object in the lamp cabinet 200 is a reflected light, no glare occurs, and there is no need to install a diffusion plate in the lamp housing to uniform the light. In this way, the volume of the lamp housing is reduced, and the lamp housing in this embodiment is thinner and a less space is occupied.

Additionally or alternatively, each of two adjacent inner walls of the lamp housing is provided with a slot, and two ends of the light board 51 in a width direction fits with the slots in a plugging-in manner, respectively. When installing the light board 51 in the installation cavity 60 of the lamp housing, the two ends of the light board 51 in a width direction are plugged into the two slots, respectively, which is convenient for installing the light board 51. When disassembling the light board 51, the light board 51 can be drawn out from the slots, and it is convenient to disassemble the light board 51. Specifically, as shown in FIG. 3, an inner surface of the first shell plate 11 is provided with a first slot 1111, and an inner surface of the second shell plate 12 located in the installation cavity 60 is provided with a second slot 122. The two ends of the light board 51 fits with the first slot 1111 and the second slot 122 in a plugging-in manner, respectively.

Additionally or alternatively, the main shell 10 of this embodiment is an integrally formed member, that is, the first shell plate 11 and the second shell plate 12 of this embodiment are integrally formed, so that the main shell 10 does not need to be assembled, which also allows the installation and disassembly of the main shell 10 to be more convenient.

Figure 5:
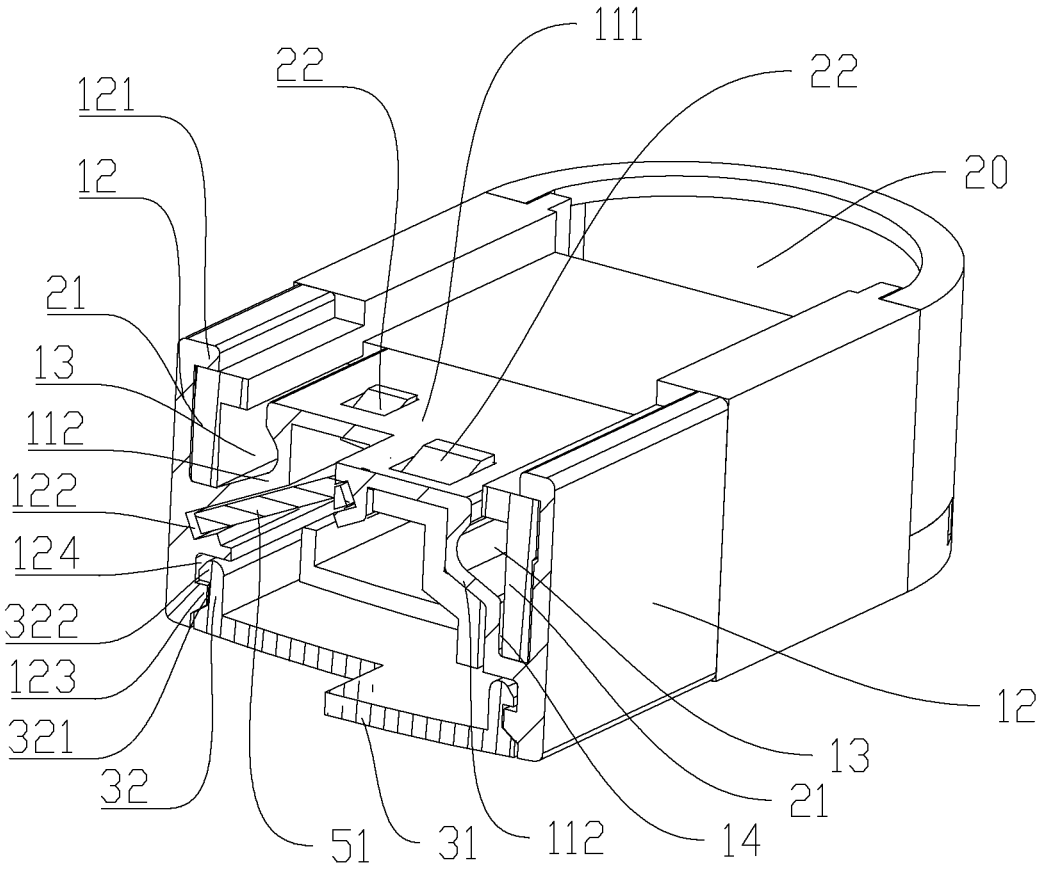
FIG. 5 is a sectional view of a connection between the main shell and an end cover provided by the one or more examples of this application.

As shown in FIG. 2 and FIG. 5, Additionally or alternatively, the lamp housing of this embodiment further includes an end cover 20, a part of the second shell plate 12 surrounding the first space 13 is an inner section, and the inner section of the second shell plate 12 is provided with a first limiting protrusion 121. The end cover 20 is provided with a guide part 21, and the guide part 21 may be an inserting block. The guide part 21 fits with the first space 13 in a plugging-in manner, and the first limiting protrusion 121 is configured to limit the guide part 21. The connection structure between the end cover 20 and the main shell 10 is simple and convenient. The end cover 20 can be detached from the main shell 10, so that it is convenient to replace the light-emitting assembly 50 in the installation cavity 60 of the lamp housing. Each of two ends of the end cover 20 in a width direction is provided with a guide part 21, and the two guide parts 21 fits with the two first spaces 13 in a plugging-in manner, respectively. The end cover 20 may be an injection molding part, which has high molding efficiency, low cost, few components, and convenient installation and disassembly.

Specifically, one end of the second shell plate 12 surrounding the first space 13 is an inner end, and the first limiting protrusion 121 is provided on the inner end of the second shell plate 12 and the first limiting protrusion 121 faces the first space 13. A gap is provided between the first limiting protrusion 121 and the first shell plate 11, which enables the main body 42 of the elastic member 40 to enter the first space 13 through the gap, and enable the first protrusion 421 on the main body 42 to be in snap fit with the first groove 1121. It is more convenient to arrange the first limiting protrusion 121 on the inner end of the second shell plate 12 than to arrange the first limiting protrusion 121 at other positions on the inner section of the second shell plate 12.

In order to further improve the connection reliability between the end cover 20 and the main shell 10, it is preferable that the end cover 20 and the main plate 111 are in snap fit with each other in this embodiment, so that it is convenient to connect the end cover 20 and the main plate 111, and it is also convenient to separate the end cover 20 from the main plate 111. After the end cover 20 is clamping in the main plate 111, the end cover 20 cannot move in the length direction of the lamp housing. In order to allow the end cover 20 to be immovable in the width direction of the lamp housing and to fix the position of the end cover 20, Additionally or alternatively, the outer surface of the first shell plate 11 and the inner surface of the second shell plate 12 in this embodiment enclose a limiting groove 14, one limiting groove 14 is provided. The guide part 21 is plugged into the limiting groove 14, and the limiting groove 14 is configured to limit the guide part 21. After the guide part 21 is plugged into the limiting groove 14, the guide part 21 cannot move in the width direction of the lamp housing, and then the entire end cover 20 cannot move in the width direction of the lamp housing.

If each of the two first spaces 13 is provided with the limiting groove 14, and the two guide parts 21 need to be limit fitting with the two limiting grooves 14, respectively, it will increase the difficulty of installing the end cover 20 on the main shell 10, or needs to improve the machining accuracy of the limiting groove 14 and the guide part 21, thereby increasing the processing cost. In this embodiment, in order to reduce the difficulty of installing the end cover 20 to the main shell 10 and to reduce the cost, as shown in FIG. 2, one of the first spaces 13 has a limiting groove 14, and the other first space 13 has no limiting groove 14. The advantage of one limiting groove 14 is that it is convenient for one of the guide parts 21 to enter into the limiting groove 14, thereby facilitating the connection between the end cover 20 and the main shell 10.

Additionally or alternatively, in this embodiment, the end cover 20 and the main plate 111 are in snap fit with each other in two ways. The first way is that the main plate 111 is provided with at least two clamping grooves 1112, the at least two clamping grooves 1112 are arranged at a spacing in a width direction of the main plate 111, and the at least two clamping grooves 1112 are distributed at different length positions of the main plate 111. The end cover 20 is provided with at least two fastening-holding parts 22, the fastening-holding parts 22 may be clamping blocks, and the clamping grooves 1112 are in snap fit with the fastening-holding parts 22, respectively. The second way is that the end cover 20 is provided with at least two clamping grooves 1112, the at least two clamping grooves 1112 are arranged at a spacing in a width direction of the end cover 20 and the at least two clamping grooves 1112 are distributed at different length positions of the end cover 20. The main plate 111 is provided with at least two fastening-holding parts 22, and the clamping grooves 1112 are in snap fit with the fastening-holding parts 22, respectively. Because a length of the cabinet lamp 100 is relatively long, in this embodiment, the at least two clamping grooves 1112 or the at least two fastening-holding parts 22 are arranged at different width positions of the cabinet lamp 100 and different length positions of the cabinet lamp 100, which is beneficial for the first shell plate 11 to subject a uniform stress.

As shown in FIG. 3, the cabinet lamp 100 of this embodiment further includes a light-transmitting cover 30. The inner surface of the first shell plate 11, the inner surface of the second shell plate 12, the light-transmitting cover 30, and the end cover 20 enclose the installation cavity 60 of the lamp housing.

A part of the second shell plate 12 surrounding the first space 13 is an inner section, and another section of the second shell plate 12 is an outer section. The light-transmitting cover 30 fits with the outer section of the second shell plate 12 in a plugging-in manner. Specifically, one end of the second shell plate 12 surrounding the first space 13 is an inner end, and another end of the second shell plate 12 is an outer end. The light-transmitting cover 30 fits with the outer end of the second shell plate 12 in a plugging-in manner. The light of the light body on the light board 51 obliquely irradiates the light-transmitting cover 30 and exits from the light-transmitting cover 30. The light-transmitting cover 30 includes a cover main body 31 and two cover sides 32. The cover main body 31 is arranged along the length direction of the lamp housing, and inner ends of the two cover sides 32 are connected to two ends of the cover body 31 in a width direction, respectively.

An outer surface of the cover side 32 is provided with a fourth slot 321 and a third limiting protrusion 322, the fourth slot 321 and the third limiting protrusion 322 are adjacent to each other, and a distance between the third limiting protrusion 322 and the first limiting protrusion 121 is smaller than a distance between the fourth slot 321 and the first limiting protrusion 121. The third limiting protrusion 322 is provided on an outer surface of an outer end of the cover side 32. An inner surface of the outer end of the second shell plate 12 is provided with a second limiting protrusion 123 and a third slot 124, the second limiting protrusion 123 and the third slot 124 are adjacent to each other. A distance between the third slot 124 and the first limiting protrusion 121 is smaller than a distance between the second limiting protrusion 123 and the first limiting protrusion 121. The second slot 122 is located between the third slot 124 and the first limiting protrusion 121.

The third limiting protrusion 322 fits with the third slot 124 in a plugging-in manner, and the second limiting protrusion 123 fits with the fourth slot 321 in a plugging-in manner. The second limiting protrusion 123 is configured to limit the third limiting protrusion 322, so that the light-transmitting cover 30 cannot move away from the first shell plate 11, and can only slide along the third slot 124 or the second limiting protrusion 123 in the length direction of the lamp housing. After the end cover 20 is installed, each of the two ends of the light-transmitting cover 30 is limited by the end cover 20 and cannot slide along the third slot 124 or the second limiting protrusion 123 in the length direction of the lamp housing, so that the position of the light-transmitting cover 30 is fixed.

The lamp housing of this embodiment includes the main shell 10, the light-transmitting cover 30, and the end cover 20. When assembling the lamp housing, the light board 51 is installed in the installation cavity 60, the light-transmitting cover 30 is installed on the main shell 10, and the end cover 20 is installed on the main shell 10 in sequence. When installing the lamp housing, the elastic member 40 is installed on the inner top wall 211 of the lamp cabinet 200 first, and then the lamp housing is connected to the elastic member 40.

A one or more examples is as follows:

As shown in FIGS. 1-6, this embodiment discloses a lamp cabinet 200. The lamp cabinet 200 includes a cabinet body and the cabinet lamp 100 of the one or more examples. The cabinet body is provided with an accommodation space 240, and the cabinet lamp 100 is installed on an inner top wall 211 of the cabinet body. The lamp cabinet 200 of this embodiment may be a cabinet, wardrobe, bookcase, etc.

The lamp cabinet 200 of this embodiment has following advantages: after the elastic member 40 is installed on the inner top wall of the lamp cabinet 200, the first space 13 of the lamp housing is aligned with the second connection part, and then the lamp housing is pushed toward the inner top wall 211 of the lamp cabinet 200, so that the second connection part enters the first space 13 first, and then the first connection part is in snap fit with the second connection part, thereby realizing the connection between the lamp housing and the elastic member 40. Compared with the existing cabinet lamp, it is more convenient for the lamp housing of the cabinet lamp 100 in this embodiment and the cabinet lamp 100 in this embodiment to be installed on the inner top wall 211 of the lamp cabinet 200. Due to the existence of the first space 13, and the elastic member 40 fits with the first space 13 in a plugging-in manner, that is, a part of the elastic member 40 is located in the first space 13, the occupied space of the cabinet lamp 100 is reduced. Because the cabinet lamp 100 in the lamp cabinet 200 occupies a less space, the lamp cabinet 200 of this embodiment has more storage space.

Additionally or alternatively, the cabinet body includes an inner top wall 211, an inner side wall, 231 and an inner bottom wall 221. The inner top wall 211, the inner side wall 231, and the inner bottom wall 221 enclose the accommodation space 240. An intersection angle between the light board 51 and the inner bottom wall 221 may range from 20 degrees to 70 degrees. The light provided by the light-emitting assembly 50 irradiates on the inner side wall 231 and is reflected to the inner bottom wall 221, and the inner bottom wall 221 is a working surface. Because the light irradiating on the working surface is a reflected light, no glare occurs. That is, the cabinet lamp 100 in the lamp cabinet 200 of this embodiment is illuminated without glare. In addition, because the light illuminating the object in the lamp cabinet 200 is the reflected light, no glare occurs, so there is no need to install a diffusion plate in the lamp housing to homogenize the light, thereby reducing the volume of the lamp housing, and allowing the lamp housing of this embodiment to be thinner and to occupy a less space, and further allowing the lamp cabinet 200 of this embodiment to have a larger storage space.

The cabinet body includes a top plate 210, a bottom plate 220, and a side plate 230. The top plate 210 and the bottom plate 220 are oppositely arranged, a top end of the side plate 230 is connected to the top plate 210, and a bottom end of the side plate 230 is connected to the bottom plate 220. The top plate 210, the bottom plate 220, and the side plate 230 enclose the accommodation space 240. The side plate 230 has an open end, and a movable cabinet door can be connected to the open end, or no cabinet door is connected to the open end.

Figure 6:
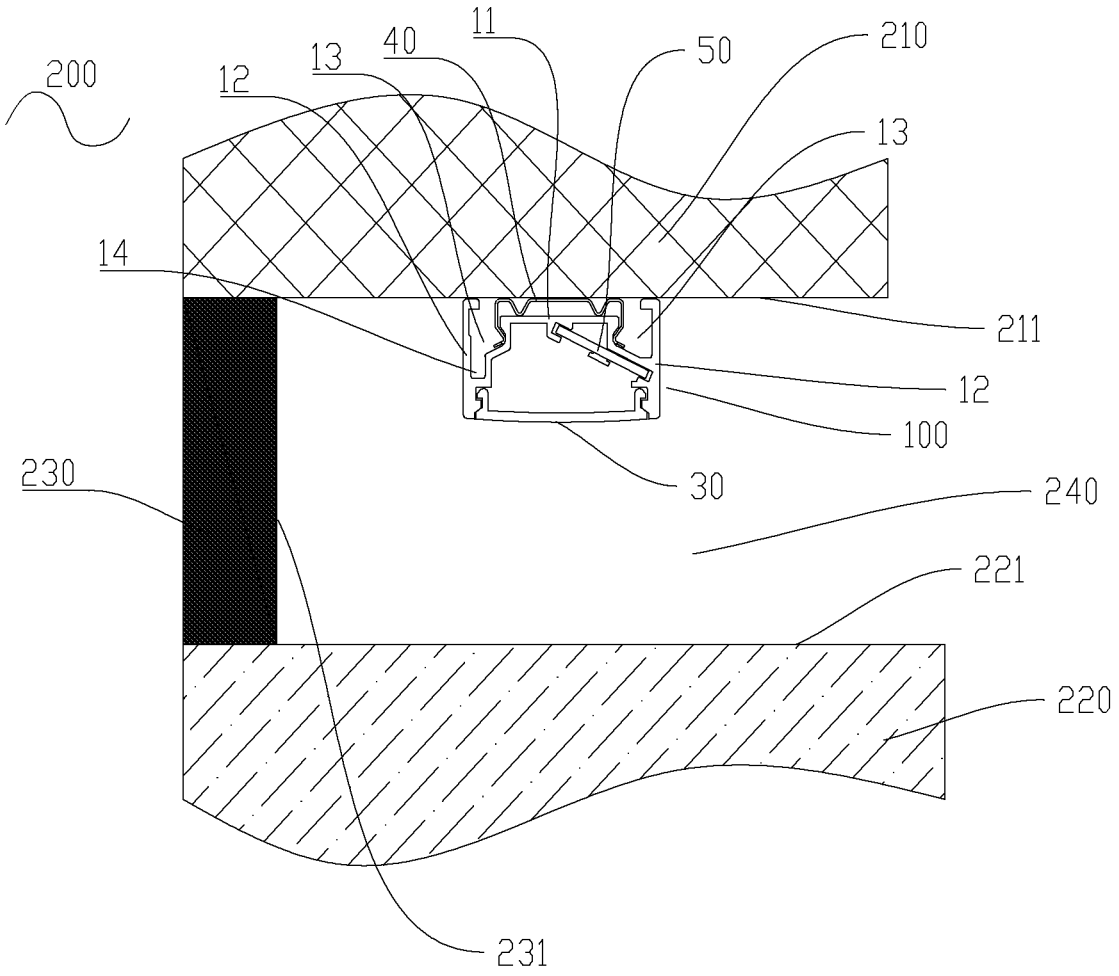
FIG. 6 is a sectional view of the lamp cabinet provided by one or more examples of this application.

A surface of the top plate 210 facing the bottom plate 220 is the inner top wall 211, and a surface of the bottom plate 220 facing the top plate 210 is the inner bottom wall 221. An inner wall of the side plate 230 is the inner side wall 231. The inner side wall 231 opposite to the open end can be used as a reflecting surface, and other inner side wall 231 can also be used as a reflecting surface. The reflecting surface is configured to reflect the light of the cabinet body. As shown in FIG. 6, the inner side wall 231 opposite to the open end in this embodiment may also be a wall surface, that is, the wall surface can be used as the reflecting surface in this embodiment.

Additionally or alternatively, in the cabinet lamp, the elastic member is formed by bending an integrally metal sheet.

Additionally or alternatively, in the cabinet lamp, a first groove is formed on a surface of the first shell plate surrounding the first space, and the first groove is the first connection part; the elastic member comprises a first protrusion, and the first protrusion is the second connection part.

Additionally or alternatively, in the cabinet lamp, a surface of the first groove is an arc surface, and a surface of the first protrusion facing the first groove is an arc surface.

Additionally or alternatively, in the cabinet lamp, two second shell plates are provided, and the first shell plate is arranged between the two second shell plates; the elastic member comprises a connection part and two main bodies connected at two ends of the connection part, and each of the two main bodies is provided with the first protrusion.

Additionally or alternatively, in the cabinet lamp, the connection part is partially bent to form a second protrusion, and a length direction of the second protrusion is parallel to a length direction of the first shell plate.

Additionally or alternatively, in the cabinet lamp, one end of the second shell plate surrounding the first space is an inner end, a surface of the connection part facing away from the first shell plate is an outer surface, and the outer surface of the connection part is coplanar with an end surface of the inner end of the second shell plate.

Additionally or alternatively, in the cabinet lamp, the light-emitting assembly comprises a light board and a light body installed on the light board, the light board is connected to the lamp housing; an intersection angle is formed between the light board and the second shell plate, and the intersection angle ranges from 20 degrees to 70 degrees.

Additionally or alternatively, in the cabinet lamp, each of two adjacent inner walls of the lamp housing is provided with a slot, and two ends of the light board fits with the slots in a plugging-in manner, respectively.

Additionally or alternatively, in the cabinet lamp, the lamp housing further comprises an end cover, a part of the second shell plate surrounding the first space is an inner section, the inner section of the second shell plate is provided with a first limiting protrusion, the end cover is provided with a guide part, the guide part fits with the first space in a plugging-in manner, and the first limiting protrusion is configured to limit the guide part.

Additionally or alternatively, in the cabinet lamp, the first shell plate comprises a main plate and two side plates, two ends of the main plate are connected to the two side plates, respectively, the side plates and the second shell plate enclose the first space, and the end cover is in snap fit with the main plate.

Additionally or alternatively, in the cabinet lamp, the first shell plate and the second shell plate enclose a limiting groove, a number of the limiting groove is one, the guide part is plugged into the limiting groove, and the limiting groove is configured to limit the guide part.

Additionally or alternatively, in the cabinet lamp, the main plate or the end cover is provided with at least two clamping grooves, the at least two clamping grooves are arranged at a spacing in a width direction of the cabinet lamp, and the at least two clamping grooves are distributed at different length positions of the cabinet lamp; the end cover or the main plate is provided with at least two fastening-holding parts, and the clamping groove is in snap fit with the fastening-holding part.

Additionally or alternatively, in the cabinet lamp, the cabinet lamp further comprises a light-transmitting cover, a part of the second shell plate surrounding the first space is an inner section and another section of the second shell plate is an outer section, and the light-transmitting cover fits with the outer section of the second shell plate in a plugging-in manner.

The lamp cabinet includes a cabinet body and the cabinet lamp, the cabinet body is provided with an accommodation space, and the cabinet lamp is installed on the inner top wall of the cabinet body. After the elastic member is installed on the inner top wall of the lamp cabinet, the lamp shell is pushed toward the inner top wall, so that the first connection part and the second connection part are in snap fit with each other, thereby realizing the connection between the lamp housing and the elastic member. It is more convenient to install the lamp housing and the cabinet lamp on the inner top wall of the lamp cabinet. The cabinet lamp occupies a less space, and the lamp cabinet has a larger storage space.

The described above are only the best embodiments of this application, and are not intended to limit this application in any form. Without departing from the scope of technical schemes of this application, those skilled in the art can make many possible changes and modifications to the technical schemes of this application by using the methods disclosed above, all of which belong to the scope of the claims.

What is claimed is:

1. A cabinet lamp, comprising:

a lamp housing comprising a first shell plate and a second shell plate, wherein the first shell plate and the second shell plate are connected to each other, the first shell plate and the second shell plate enclose a first space, a surface of the first shell plate surrounding the first space or a surface of the second shell plate surrounding the first space is provided with a first connection part;

an elastic member comprising a second connection part, wherein the elastic member fits with the first space in a plugging-in manner, the second connection part is in snap fit with the first connection part, and the elastic member is configured to be installed on an inner top wall of a lamp cabinet; and a light-emitting assembly installed on the lamp housing, wherein a first end of the light-emitting assembly is installed on a first inner wall of the first shell plate, a second end of the light-emitting assembly is installed on a second inner wall of the second shell plate, and an intersection angle between the light-emitting assembly and the second shell plate ranges from 20 degrees to 70 degrees.

2. The cabinet lamp according to claim 1, wherein the elastic member is formed by bending an integrally metal sheet.

3. The cabinet lamp according to claim 1, wherein a first groove is formed on a surface of the first shell plate surrounding the first space, and the first groove is the first connection part; the elastic member comprises a first protrusion, and the first protrusion is the second connection part.

4. The cabinet lamp according to claim 3, wherein a surface of the first groove is an arc surface, and a surface of the first protrusion facing the first groove is an arc surface.

5. The cabinet lamp according to claim 3, wherein two second shell plates are provided, and the first shell plate is arranged between the two second shell plates; the elastic member comprises a connection part and two main bodies connected at two ends of the connection part, and each of the two main bodies is provided with the first protrusion.

6. The cabinet lamp according to claim 5, wherein the connection part is partially bent to form a second protrusion, and a length direction of the second protrusion is parallel to a length direction of the first shell plate.

7. The cabinet lamp according to claim 5, wherein one end of the second shell plate surrounding the first space is an inner end, a surface of the connection part facing away from the first shell plate is an outer surface, and the outer surface of the connection part is coplanar with an end surface of the inner end of the second shell plate.

8. The cabinet lamp according to claim 1, wherein the light-emitting assembly comprises a light board and a light body installed on the light board, the light board is connected to the lamp housing; the intersection angle is formed between the light board and the second shell plate.

9. The cabinet lamp according to claim 8, wherein each of two adjacent inner walls of the lamp housing is provided with a slot, and two ends of the light board fits with the slots in a plugging-in manner, respectively.

10. The cabinet lamp according to claim 9, wherein the lamp housing further comprises an end cover, a part of the second shell plate surrounding the first space is an inner section, the inner section of the second shell plate is provided with a first limiting protrusion, the end cover is provided with a guide part, the guide part fits with the first space in a plugging-in manner, and the first limiting protrusion is configured to limit the guide part.

11. The cabinet lamp according to claim 10, wherein the first shell plate comprises a main plate and two side plates, two ends of the main plate are connected to the two side plates, respectively, the side plates and the second shell plate enclose the first space, and the end cover is in snap fit with the main plate.

12. The cabinet lamp according to claim 10, wherein the first shell plate and the second shell plate enclose a limiting groove, a number of the limiting groove is one, the guide part is plugged into the limiting groove, and the limiting groove is configured to limit the guide part.

13. The cabinet lamp according to claim 11, wherein the main plate or the end cover is provided with at least two clamping grooves, the at least two clamping grooves are arranged at a spacing in a width direction of the cabinet lamp, and the at least two clamping grooves are distributed at different length positions of the cabinet lamp; the end cover or the main plate is provided with at least two fastening-holding parts, and the clamping groove is in snap fit with the fastening-holding parts.

14. The cabinet lamp according to claim 1, wherein the cabinet lamp further comprises a light-transmitting cover, a part of the second shell plate surrounding the first space is an inner section and another section of the second shell plate is an outer section, and the light-transmitting cover fits with the outer section of the second shell plate in a plugging-in manner.

15. A lamp cabinet, comprising:

a cabinet body, and a cabinet lamp comprising:

a lamp housing comprising a first shell plate and a second shell plate, wherein the first shell plate and the second shell plate are connected to each other, the first shell plate and the second shell plate enclose a first space, a surface of the first shell plate surrounding the first space or a surface of the second shell plate surrounding the first space is provided with a first connection part;

an elastic member comprising a second connection part, wherein the elastic member fits with the first space in a plugging-in manner, the second connection part is in snap fit with the first connection part, and the elastic member is configured to be installed on an inner top wall of a lamp cabinet; and a light-emitting assembly installed on the lamp housing, wherein a first end of the light-emitting assembly is installed on a first inner wall of the first shell plate, a second end of the light-emitting assembly is installed on a second inner wall of the second shell plate, and an intersection angle between the light-emitting assembly and the second shell plate ranges from 20 degrees to 70 degrees, wherein the cabinet body is provided with an accommodation space, and the cabinet lamp is installed on an inner top wall of the cabinet body.

* * * * *